United States Patent [19]

Lester

[11] Patent Number: 4,724,362

[45] Date of Patent: Feb. 9, 1988

[54] HIGH FREQUENCY LAMP IGNITER USING A SPIRAL LINE PULSE GENERATOR IN COMBINATION WITH A SERIES INDUCTOR-SWITCH CIRCUIT

[75] Inventor: James N. Lester, Rockport, Mass.

[73] Assignee: GTE Products Corporation, Danvers, Mass.

[21] Appl. No.: 812,537

[22] Filed: Dec. 23, 1985

[51] Int. Cl.[4] ..... H05B 37/00

[52] U.S. Cl. ..... 315/289; 315/290; 315/241 R; 315/244; 315/39; 307/106; 307/108; 307/110

[58] Field of Search ..... 315/289, 290, 244, 241 R, 315/239, 45, 47, DIG. 5, DIG. 7; 307/106, 108, 110, 157

[56] References Cited

U.S. PATENT DOCUMENTS

| | | | |
|---|---|---|---|
| 3,195,031 | 7/1965 | Fitch et al. . | |
| 3,239,732 | 3/1966 | Fitch et al. . | |
| 3,289,015 | 11/1966 | Fitch et al. . | |
| 3,629,683 | 12/1971 | Nuckolls | 315/241 |
| 3,917,976 | 11/1975 | Nuckolls | 315/DIG. 5 |
| 4,325,004 | 4/1982 | Proud et al. | 315/45 |
| 4,327,311 | 4/1982 | Wroblewski | 315/DIG. 5 |
| 4,353,012 | 10/1982 | Fallier, Jr. et al. | 315/241 R |
| 4,376,911 | 3/1983 | Kaneda | 315/244 |
| 4,379,982 | 4/1983 | Proud | 315/73 |
| 4,484,085 | 11/1984 | Fallier, Jr. et al. | 307/106 |
| 4,572,988 | 2/1986 | Handler et al. | 315/DIG. 5 |
| 4,680,509 | 7/1987 | Fallier, Jr. et al. | 315/241 R |

OTHER PUBLICATIONS

Fitch et al., "Novel Principle of Transcient High Voltage Generation," Apr. 1964, *IEEE Proceedings*, vol. III, No. 4, pp. 849–855.

*Primary Examiner*—Leo H. Boudreau
*Assistant Examiner*—Michael J. Nickerson
*Attorney, Agent, or Firm*—José W. Jimenez; Carlo S. Bessone

[57] ABSTRACT

A light source including a spiral line pulse generator having an output coupled to one electrode of a high pressure discharge lamp and having an input for coupling to a source of lamp operating power for providing high voltage lamp starting pulses. This pulse generator includes, in addition to a spiral line generator, a solid state electronic switch in combination with an inductor. The electronic switch and inductor are connected in series between the conductors of the spiral line pulse generator for multiple discharge of the spiral line pulse generator to provide multiple high voltage pulses during each half cycle of lamp operating power to initiate discharge in the high pressure discharge lamp.

15 Claims, 7 Drawing Figures

Fig. 1
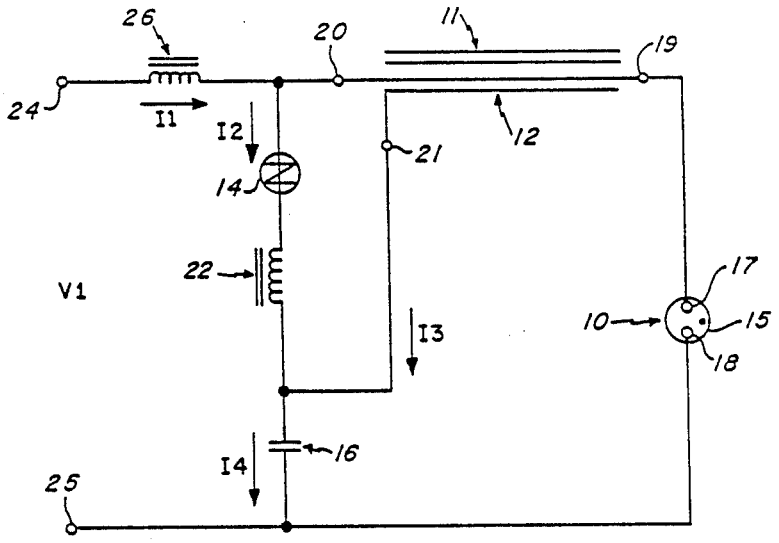
Fig. 2
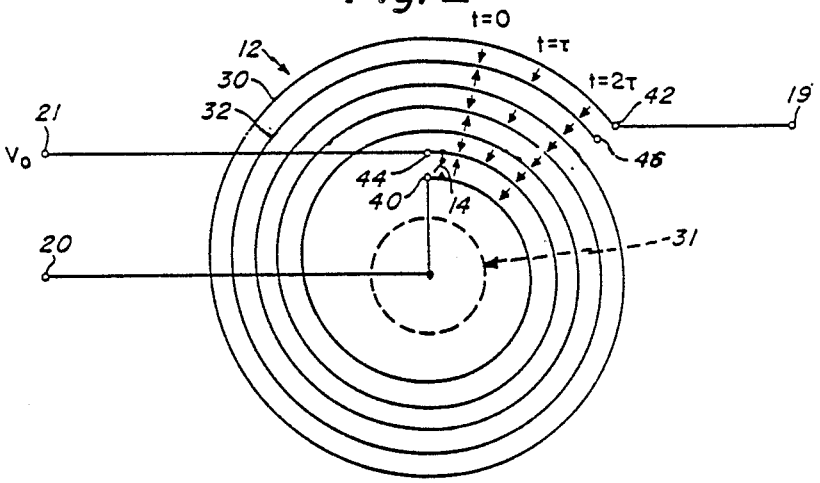
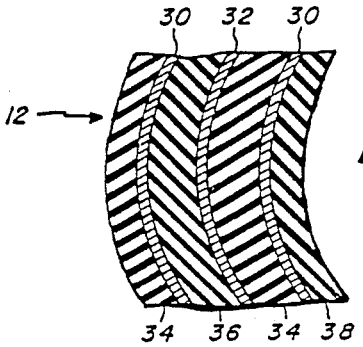
Fig. 3

HIGH FREQUENCY LAMP IGNITER USING A SPIRAL LINE PULSE GENERATOR IN COMBINATION WITH A SERIES INDUCTOR-SWITCH CIRCUIT

TECHNICAL FIELD

The present invention relates in general to the starting of high intensity discharge lamps and pertains, more particularly, to a new and improved lamp igniter apparatus utilizing a spiral line pulse generator. The lamp igniter apparatus provides high voltage, short duration pulses for starting high intensity discharge lamps.

BACKGROUND OF THE INVENTION

A spiral line pulse generator is disclosed by R. A. Fitch, et al in U.S. Pat. No. 3,289,015, issued Nov. 29, 1966. The generator is a device capable of storing electrical energy and, upon momentary short circuiting of a pair of terminals associated with the device, of providing a high amplitude pulse. The spiral line pulse genrator, when properly utilized, provides the dual function of energy storage and voltage multiplication. The spiral line pulse generator is a transient field reversal device that provides an approximately triangular pulse. Its peak voltage is a multiple of the initial charging voltage. The construction of the spiral line is such that the voltage from the beginning to the end of the line adds through vector inversion producing a very high voltage pulse.

Some arc discharge lamps are known to be particularly difficult to start. One example of such a lamp is an arc lamp containing a sodium amalgam and a noble gas such as xenon at a relatively high pressure, such as 500 Torr. Another example of a difficult lamp to start is a metal halide lamp which requires a higher starting voltage than is available from an AC voltage line, of a wide range of voltages, with the use of a simple lead-lag ballast.

The use of a spiral line pulse generator to start high pressure sodium lamps is disclosed in U.S. Pat. No. 4,325,004 to J. M. Proud, et al issued Apr. 13, 1982 and assigned to the assignee of the present application. In this patent, the output of the spiral line pulse generator is coupled to a conductor or starting aid, located in close proximity to an outer surface of the discharge tube. In the case of metal halide lamps, it has been found undesirable to locate conductors in close proximity to the central portion of the discharge tube, thereby ruling out the use of a starting aid to assist in initiating discharge in metal halide lamps.

U.S. Pat. No. 4,353,012 to C. N. Fallier, Jr. et al, issued Oct. 5, 1982, and also assigned to the assignee of the present application, shows a starting circuit for high intensity discharge metal halide lamps which comprises a spiral line pulse generator including two conductors and two insulators, each in the form of an elongated sheet, constructed in an alternating and overlapping arrangement which is rolled together in a spiral configuration having a plurality of turns. The spiral line pulse generator includes an output terminal coupled to one of the electrodes of the lamp and a pair of input terminals. One of the input terminals and the other of the electrodes of the lamp are adapted for coupling to a source of lamp operating power for delivering lamp operating power, received from the source, through the spiral line pulse generator to the discharge lamp. The starting circuit includes a spark gap and series resistor for applying a voltage between the conductors of the spiral line pulse generator and for switching the generator from a first voltage to a second voltage in a time interval much shorter than the transit time of electromagnetic waves through the spiral line pulse generator. After operation of the spark gap switch, the spiral line pulse generator provides, at its output terminal, a high voltage, short duration pulse of sufficient energy to initiate discharge in the discharge lamp.

U.S. Pat. No. 4,680,509 entitled "Method and Apparatus For Starting HID Lamps," to Charles N. Fallier, Jr., and James Lester, filed concurrently herewith describes a spiral line lamp starter circuit utilizing a solid state electronic switch as means for discharging the spiral line causing a high voltage spiral line pulse to appear at the lamp. Upon conduction of the solid state electronic switch the line current diverts therethrough maintaining the switch conductive until the current through the switch drops below the holding current level of the solid state electronic switch. This usually occurs when the line voltage is near zero volts. Thus, only one pulse occurs per half cycle of the line voltage. Several cycles may thus have to occur before proper lamp starting is completed.

SUMMARY OF THE INVENTION

Accordingly, it is an object of the present invention to provide a new and improved apparatus for the starting of high intensity discharge lamps, and in particular lamps that are normally difficult to start, such as high pressure sodium lamps containing noble gasses or metal halide lamps.

Another object of the present invention is to provide an improved lamp igniter circuit that enhances the starting capabilities of arc discharge lamps at substantially reduced peak voltages preferably under 4 KV and an igniter circuit that is low in cost, has a minimal number of component parts, and in which the high voltage components are easy to fabricate, particularly in comparison to magnetic pulse transformer designs.

According to one aspect of the invention, there is provided a light source that comprises a high pressure discharge lamp and a pulse generator means. The high pressure discharge lamp includes a discharge tube having electrodes sealed therein and enclosing a fill material which emits light during discharge. The pulse generator means includes a spiral line pulse generator having two conductors and two insulators, each in the form of an elongated sheet, in an alternating and overlapping arrangement which is rolled together in a spiral configuration having a plurality of turns. The spiral line pulse generator includes an output terminal coupled to one of the electrodes of the lamp and also a pair of input terminals. One of the input terminals and the other one of the electrodes of the discharge lamp are adapted for coupling to a source of lamp operating power. The pulse generator means also includes a switch means, inductance means and means for coupling the switch means and inductance means in series between the conductors of the spiral line pulse generator. The switch means is arranged to short circuit the conductors of the spiral line pulse generator for discharge thereof. Impedance means couples from one of the conductors of the spiral line generator to the other of the lamp electrodes. The spiral line pulse generator, after operation of the switch means provides at the output thereof multiple high voltage pulses during each half cycle of lamp operation power to initiate discharge in the high pressure discharge lamp.

In accordance with another aspect of the present invention, there is provided a method for starting a high pressure discharge lamp of the type including a discharge tube having electrodes sealed therein for receiving AC power from a lamp ballast and enclosing a fill material which emits light during discharge. This method comprises the steps of applying the AC source power between two conductors of a spiral line pulse generator including the two conductors and two insulators, each in the form of an elongated sheet, in an alternating and overlapping arrangement which is rolled together in a spiral configuration having a plurality of turns; the spiral line pulse generator further including an output taken between an innermost turn and an outermost turn of the spiral configuration. The method further includes the step of switching the conductors so as to provide a high voltage pulse upon discharge of the spiral line pulse generator; and commutating said switching of the conductors at least once during a half cycle of the AC voltage so as to enable recharging of the spiral line pulse generator. Finally, the method includes subsequently switching the conductors to again discharge the spiral line pulse generator so as to provide multiple high voltage pulses during each half cycle of lamp operating power to initiate discharge in the high pressure discharge lamp.

BRIEF DESCRIPTION OF THE DRAWINGS

FIG. 1 is a schematic diagram of spiral line starter circuit and light source made in accordance with the teachings of the present invention;

FIG. 2 is a simplified schematic diagram of a spiral line pulse generator;

FIG. 3 is a partial cross-sectional view of the spiral line pulse generator shown in FIG. 2;

BEST MODE FOR CARRYING OUT THE INVENTION

Figure 4A:
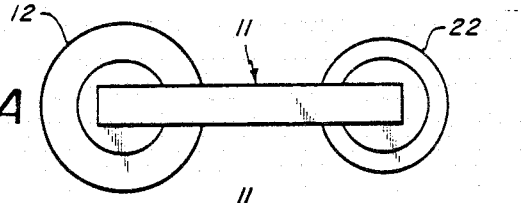
FIGS. 4A and 4B illustrate in top plan and side elevation views, respectively, the ferromagnetic core with circuit components associated therewith.

For a better understanding of the present invention, together with other and further objects, advantages and capabilities thereof, reference is made to the following disclosure and appended Claims in connection with the above described drawings.

The spiral line starter circuit originally evolved as a starting device for lamps requiring a single low energy high voltage starting pulse. However, some lamps such as metal halide lamps are more difficult to start and generally will not start with a single pulse unless it is a very high voltage pulse say on the order of 10–20 KV. However, there is now described in the light source herein an improvement to the spiral line starter circuit which enables operation as a high frequency pulse starter enhancing the starting capability of arc discharge lamps at substantially reduced peak voltages on the order of but preferably less than 4 KV.

A high intensity light source starter circuit in accordance with the present invention is shown in schematic form in FIG. 1, comprising a high pressure discharge lamp 10, a spiral line pulse generator 12, a solid state electronic switch 14, and ballast capacitor 16. Discharge lamp 10 may be a high pressure sodium lamp including a noble gas or a high intensity metal halide discharge lamp. FIG. 1 illustrates a metal halide lamp that comprises a discharge tube 15 having a pair of electrodes 17 and 18 sealed therein. Spiral line pulse generator 12 includes an output terminal 19 which is coupled to electrode 17 of discharge lamp 10. Solid state electronic switch 14 is coupled in series with an inductance means 22 across a pair of input terminals 20, 21 of spiral line pulse generator 12.

At the input to the circuit of FIG. 1, there is provided an input AC voltage impressed at the terminals 24 and 25. This input voltage may have a peak-to-peak AC value of 277 volts at 60 Hertz. The source of lamp operating power also includes a ballast 26 which couples input terminal 24 to input terminal 20 of spiral line pulse generator 12. Ballast capacitor 16 is coupled between input terminal 21 of the spiral line pulse generator 12 and electrode 18 of discharge lamp 10.

Discharge lamp 10 is a conventional high intensity discharge metal halide lamp in which no starting aid is included. Discharge tube 15 is typically fused silica and contains a noble gas at low pressure and various volatile fill materials including mercury and one or more metal halides, typically metal iodides. The discharge current flows between electrodes 17 and 18 after discharge has been initiated by a high voltage pulse.

Spiral line pulse generator 12 is shown in simplified form in FIG. 2 for ease of understanding. A pair of conductors 30 and 32 in the form of elongated sheets of conductive material are rolled together to form a multiple turn spiral configuration. FIG. 3 is a partial cross-sectional view of spiral line pulse generator 12 illustrating the layered construction of the device. A four-layered arrangement of alternating conductors and insulators, including the conductors 30 and 32 and a pair of insulators 34 and 36, is rolled onto a form 38 in a multiple turn spiral configuration, form 38 providing mechanical rigidity. Conductors 30 and 32 are separated by dielectric material at every point in the spiral configuration.

The operation of spiral line pulse generator 12 can be described with reference to FIG. 2, which schematically shows conductors 30 and 32. Conductor 30 runs from point 40 to point 42 while conductor 32 runs from point 44 to point 46. In the present example, switch 14 is coupled between conductors 30 and 32 at or near the points 40 and 44. A voltage is applied between conductors 30 and 32. Prior to the closing of switch 14. conductor 30 has a uniform potential between points 40 and 42 and conductor 32 has a uniform potential between points 44 and 46. The voltage difference between the innermost and the outermost turns of the spiral configuration is at most $2nV_O$. This can be seen by summing the electric field vectors at time $t=0$ as shown in FIG. 2. When switch 14 is rapidly closed, a field reversing wave propagates along the transmission line formed by conductors 30 and 32. When the wave reaches points 42 and 46, at time $t=\tau$, the potential difference between the points 42 and 40 is $nV_o$, where n is the number of turns in the spiral configuration, due to the absence of cancelling static field vectors. As is well known, the propagating wave undergoes an in-phase reflection at points 42 and 46 when these points are terminated in a high impedance or are open circuited as shown in FIG. 2. This results in an additional increase in the potential difference between the innermost and outermost conductors with a maximum occurring at time $t=2\tau$ at which time the field vectors are aligned as shown in FIG. 2. The output taken between point 42 or 46 and point 40 reaches a maximum voltage of $2nV_o$ at $t=2\tau$ after the closure of switch 14. The operation of spiral line pulse generator 12 is described in further detail in U.S. Pat. No. 3,289,015 and in Pitch et al, "Novel Principle of Transient High Voltage Generation," Proc. IEE, Vol. 111, No. 4, April 1964.

Reference is also made herein to U.S. Pat. No. 4,353,012 to C. N. Fallier, Jr., et al that provides further details of the spiral line construction, characteristics, and related parameters and equations.

In U.S. Pat. No. 4,680,509 (referred to earlier in this application), as well as in U.S. Pat. No. 4,353,012 both assigned to the present assignee herein, there are described spiral line starter circuits in which a single pulse output occurs for each half cycle of the line voltage. In the circuit described in U.S. Pat. No. 4,680,509 (Fallier, Jr. et al) there is provided an electronic switch (sidac) which, when switched, discharges the spiral line pulse generator therethrough causing a high voltage spiral line pulse to appear at the lamp. The input source current maintains the electronic switch in a conductive condition until the input current returns to near zero volts thus permitting only a single pulse per half cycle of the line voltage.

Now, there is described herein in connection with the schematic diagram of FIG. 1 a starter circuit that comprises, not only electronic switch 14 and capacitor 16 but also an inductance means 22 (e.g., inductor) that operates in conjunction with electronic switch 14 and spiral line pulse generator 12 so as to provide multiple high voltage pulses during each half cycle of the line voltage. This enables starting of the arc discharge lamp at substantially reduced peak voltages usually under 4 KV.

In the schematic diagram of FIG. 1, inductance means 22 operates to commutate sidac switch 14 to interrupt conduction of switch 14 after initiation of discharge of spiral line pulse generator 12. This commutating or turning off of switch 14 occurs while the line voltage is still high thus allowing spiral line pulse generator 12 to rapidly recharge and thus repeat the pulse generating cycle many times each half cycle of the line voltage. When electronic switch 14 turns on, the capacitance of spiral line pulse generator 12 is discharged through inductance means 22 in a resonant manner. In this connection, note a current 12 passing through switch 14 and inductor 22 and also a current 13 flowing from spiral line pulse generator 12. The peak resonant current transferred between the spiral line capacitance and the inductor 22 is much larger than the line current 11 so that at some time during the discharge of the spiral line pulse generator, the current through switch 14 passes through zero. At that time switch 14 turns off allowing current 11 to again recharge spiral line pulse generator 12. This resonant action between the spiral line pulse generator and the inductor takes place at about a 10 KHz rate for the specific circuit illustrated in FIG. 1 with the components as identified on the diagram.

With reference to the diagram of FIG. 1, commutating inductor 22 has a preferred value of about 2.0 mH (millihenries). The value of this inductor is preferably within a range of about 1.0–5.0 mH. This value has been selected based upon the use of a circuit design having a maximum voltage breakdown of about 4.0 KV. A value of inductor 22 under 1.0 mH has substantially no effect on the spiral line peak voltage but an insufficient number of pulses per half cycle of the 60 Hertz line is created for effective lamp starting. By increasing the inductance beyond 1.0 mH to the preferred 2.0 mH the peak pulse voltage substantially remains the same (about 4.0 KV) while the largest number of oscillating pulses are created without circuit (or socket) breakdown. The greater the inductance the more stability occurs as far as providing commutating oscillations to provide multiple pulses. The increased inductance slows down the rate of change of current so that the electronic switch has a chance to turn off and thus provide the desired resonant operation. In selecting a value for the inductor, a balance must be struck between achieving the greatest number of oscillating pulses and not reducing the peak pulse voltage. Values of inductor 22 greater than 5.0 mH reduce the peak voltage to unacceptable levels, usually below 3 KV. It is noted also that the value of inductor 22 is small relative to the distributed spiral line inductance.

In FIG. 1, ballast capacitor 16 controls the amount of power drawn by the starter and also affects the number of output pulses. A typical range of values of capacitor 16 is between about 0.5 and 4.0 microfarad. As indicated on the diagram the selected value of capacitor 16 is about 1.0 microfarad.

Figure 4B:
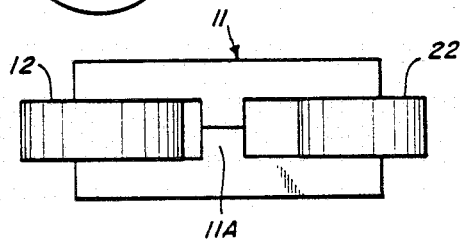

As indicated previously, a ferrite magnetic core has been added to the spiral line construction. This is illustrated schematically by the dotted outline of a ferromagnetic core 31 in FIG. 2. The magnetic core may be made of any other magnetic material and need not be limited to ferrites. In this regard, reference is also made to FIGS. 4A and 4B which illustrate the spiral line pulse generator 12 and inductor 22 as wound upon a closed loop ferrite magnetic core 11. In FIGS. 4A and 4B the ferrite core is of the "double E" type having a substantially rectangular core segment, but may be cylindrical in other embodiments, and opposite end segments. Spiral line pulse generator 12 is wound on one of the end segments and inductor 22 is wound on the other end segment. The center core segment 11A is common from a magnetic flux standpoint to both spiral line pulse generator 12 and inductor 22.

As also indicated previously, the ferrite magnetic core increases the distributed spiral line inductance. The use of the ferromagnetic core utilizes the spiral line winding more efficiently so as to achieve a voltage step-up that is more proportional to the number of turns in the spiral line pulse generator. Thus, the use of the core in conjunction with the spiral line allows the use of a slower switching device in place of the previously used spark gap. The slower switching device in accordance with the invention may be a solid state electronic switch such as a sidac. Such a device may have a breakdown voltage, in one example, of 240 volts with a low conducting voltage drop thereacross. The breakdown voltage is selected to be greater than the lamp operating voltage, once started, so that the sidac is essentially out of the circuit after the lamp has been started.

Figure 5A:
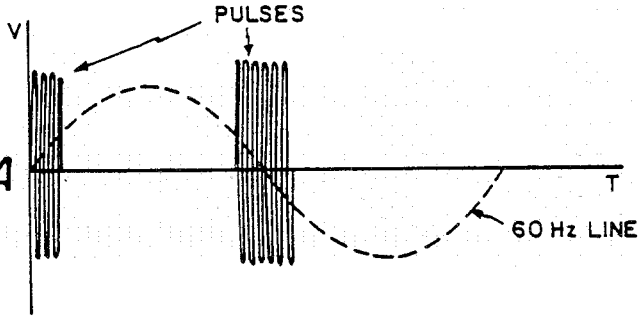
FIGS. 5A and 5B illustrate waveforms associated with the schematic diagram of FIG. 1.
Figure 5A:
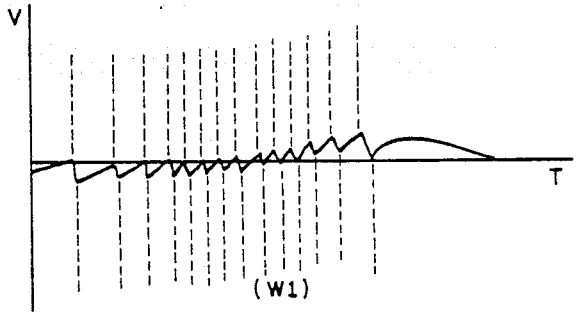
Figure 5B:
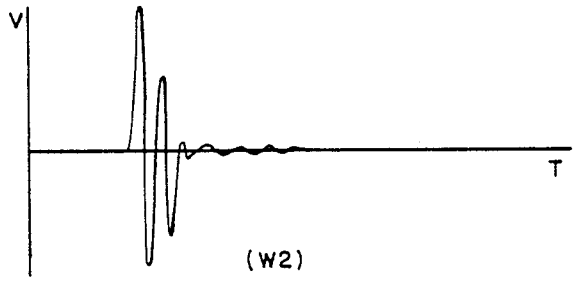

Reference is also now made to FIGS. 5A and 5B which illustrate waveforms associated with the schematic diagram of FIG. 1. In FIG. 5A there is shown a waveform that illustrates the R.F. high frequency pulses, on a 60 Hertz power line (the generation of multiple pulses). that occur each half cycle as in accordance with the invention. In FIG. 5B, there are shown two waveforms, W1 and W2, that are enlargements of one burst of pulses (burst duration=2.4 milliseconds: no. of pulses=14) and of a single pulse within "one"

pulse (showing 3 actual pulses) of W1, respectively. Therefore, the total number of pulses per burst is about 42, with a peak voltage of about 4 KVolts. Each of the 14 pulses has about 3 "rings" before decaying.

While there has been shown and described what is at present considered the preferred embodiment of the invention it should be obvious to those skilled in the art that various changes and modifications may be made therein without departing from the scope of the invention as defined by the appended claims. For example, in the schematic diagram of FIG. 1 inductor 22 is shown coupling in a circuit leg including switch 14 and capacitor 16. In an alternate embodiment of the invention it operates substantially the same. Inductor 22 may be coupled to the conductive line that connects from input terminal 21 of the spiral line pulse generator 12 to capacitor 16.

What is claimed is:

1. Apparatus for starting a high pressure discharge lamp of the type including a discharge tube having a pair of electrodes sealed therein and enclosing a fill material which emits light during discharge, said apparatus comprising:

a spiral line pulse generator including two conductors and two insulators, each in the form of an elongated sheet, in an alternating and overlapping arrangement which is rolled together in a spiral configuration having a plurality of turns;

said spiral line pulse generator including an output terminal coupled to one of said electrodes of said lamp and a pair of input terminals, one of said input terminals and the other of said electrodes of said lamp being adapted for coupling to a source of AC lamp operating power, received from said source, through said spiral line pulse generator to said discharge lamp;

impedance means coupled from one of the conductors of said spiral line pulse generator to the other of said lamp electrodes;

switch means;

inductance means; and means coupling the switch means and inductance means in series between the conductors of said spiral line pulse generator, said switch means arranged to short circuit said conductors for discharging said spiral line pulse generator whereupon said spiral line pulse generator, upon application of a source of AC lamp operating power and periodic operation of said switch means, provides at said output terminal multiple high voltage pulses during each half cycle of said AC lamp operating power to initiate discharge in said high pressure discharge lamp.

2. The apparatus as set forth in claim 1 wherein said high pressure discharge lamp comprises a high pressure sodium lamp including a noble gas.

3. The apparatus as set forth in claim 1 wherein said high pressure discharge lamp comprises a metal halide discharge lamp.

4. The apparatus as set forth in claim 1 wherein said switch means comprises a solid state electronic switch.

5. The apparatus as set forth in claim 4 wherein said solid state electronic switch has a turn-on voltage on the order of about one volt.

6. The apparatus as set forth in claim 4 wherein said solid state electronic switch comprises a sidac.

7. The apparatus as set forth in claim 1 wherein said spiral pulse generator has a magnetic core means for increasing the spiral line inductance.

8. The apparatus as set forth in claim 1 wherein said impedance means comprises a capacitor.

9. The apparatus as set forth in claim 8 wherein said capacitor has a value in the range of about 0.5 to about 4.0 microfarads.

10. The apparatus as set forth in claim 1 wherein said inductance means has a value in the range of about 1.0 to about 5.0 millihenries.

11. The apparatus as set forth in claim 1 including ballast means coupling from said source of lamp operating power to said one input terminal of said spiral line pulse generator.

12. The apparatus as set forth in claim 1 including a magnetic core means having a first leg upon which said spiral line pulse generator is disposed and a second leg upon which said inductance means is disposed.

13. The apparatus as set forth in claim 12 wherein said magnetic core means comprises a closed loop core having a third leg common to said spiral line pulse generator and said inductance means.

14. A method for starting a high pressure discharge lamp of the type including a discharge tube having electrodes sealed therein for receving AC power from a lamp ballast and enclosing a fill material which emits light during discharge, said method comprising the steps of:

applying the AC source power between two conductors of a spiral line pulse generator including said two conductors and two insulators, each in the form of an elongated sheet, in an alternating and overlapping arrangement which is rolled together in a spiral configuration having a plurality of turns, said spiral line pulse generator further including an output taken between an innermost turn and an outermost turn of said spiral configuration:

switching said conductors so as to provide a high voltage pulse upon discharge of said spiral line pulse generator:

commutating the switching of said conductors at least once during a half cycle of the AC voltage so as to enable recharging of the spiral line pulse generator: and subsequently switching said conductors to again discharge said spiral line pulse generator so as to provide multiple high voltage pulses during each half cycle of lamp operating power to initiate discharge in said high pressure discharge lamp.

15. A method as set forth in Claim 14 wherein said step of commutating said switching of said conductors includes providing an inductor in series with an electronic switch for providing commutation of the switching action between the electronic switch and the spiral line pulse generator.

* * * * *